United States Patent [19]

Kamon et al.

[11] 4,429,194

[45] Jan. 31, 1984

[54] EARPHONE

[75] Inventors: Yoshoyuki Kamon; Yoshihiro Yokoyama, both of Yokohama, Japan

[73] Assignee: Sony Corporation, Tokyo, Japan

[21] Appl. No.: 269,869

[22] Filed: Jun. 3, 1981

[30] Foreign Application Priority Data

Jun. 6, 1980 [JP] Japan ..... 55-79090[U]

[51] Int. Cl.[3] ..... H04R 1/10

[52] U.S. Cl. ..... 179/182 R; 179/182 A; 179/186

[58] Field of Search ..... 181/133, 136, 129, DIG. 1; 179/156 B, 156 A, 179, 157, 182 R, 182 A, 181; 3/107 E, 107 H, 1

[56] References Cited

U.S. PATENT DOCUMENTS

| | | | |
|---|---|---|---|
| 1,753,817 | 4/1930 | Aber | 179/182 |
| 2,975,244 | 3/1961 | Lehr | 179/156 |
| 3,293,379 | 12/1966 | Görike | 179/115.5 |
| 3,565,073 | 2/1971 | Giesy | 128/283 |
| 3,586,794 | 6/1971 | Michaelis | 179/182 R |
| 4,258,705 | 3/1981 | Sorenson et al. | 128/1 R |

*Primary Examiner*—A. D. Pellinen
*Assistant Examiner*—Robert Lev
*Attorney, Agent, or Firm*—Hill, Van Santen, Steadman & Simpson

[57] ABSTRACT

An earphone comprising a housing formed on the outer periphery of the front face with a flange for preventing the housing from disengagement from the concha when the housing is received in a recess of the concha, said housing being sized to be received in the recess of the concha and having an electroacaustic transducer built in.

5 Claims, 4 Drawing Figures

EARPHONE

BACKGROUND OF THE INVENTION

1. Field of the Invention

This invention relates to an earphone, and more particularly to a very compact and light earphone which can be used comfortably and attached to the ear securely.

2. Description of the Prior Art

Conventional earphones used for the appreciation of music or the like are known such as for example, air tight magnetic type earphones and the so-called dynamic type earphones.

In magnetic type earphones, an iron piece is disposed in front of a coil and yoke constituting a magnet circuit so as to vibrate the iron piece, and a vinyl tube is attached to a projection having a vent hole which is formed in front of the iron piece and which is inserted into the interior of the external auditory meatus (canal) of a wearer. In this type of earphone, however, since the vinyl tube has to be inserted into the interior of the external auditory meatus, it causes discomfort and often becomes covered with sweat. Also, since the vinyl tube supports the earphone to prevent it from disengagement from the concha, the iron piece which is a vibrative member is located remotely from the eardrum so that satisfactory high fidelity sounds can not advantageously obtained.

Also, in dynamic type earphones, a diaphragm is vibrated in a magnetic circuit formed of a voice coil, a yoke, a magnet and a plate. This type of earphone, has a projection having a vent hole formed in front of a diaphragm and an attachment formed of urethane or the like which is attached to the projection which is to be inserted into the interior of the external auditory meatus of a user during use and it inevitably causes physical discomfort.

SUMMARY OF THE INVENTION

An object of this invention is to provide a compact and light earphone.

Another object of this invention is to provide an earphone which is provided with a housing which is received in a recess of the concha and a transducer which is received in the housing and is suitable for reproducing high fidelity sounds.

Still another object of this invention is to provide an earphone which is provided with a housing having a built in transducer built and a flange formed on the housing for engaging projections of the concha to prevent the earphone from disengagement from the concha when the housing is received in a recess of the concha.

A further object of this invention is to provide an earphone in which a transducer is provided in a housing attached to the concha and the diameter of the diaphragm in the transducer is substantially equal to that of the housing so that the diaphragm is located sufficiently close to the eardrum for transmitting satisfactory the reproduced sounds.

A still further object of this invention is to provide an earphone in which an earphone body is provided with a clip which clips to a portion of the concha so as not to disengage the earphone body from the concha even when the user wears the earphone while doing strenuous exercises.

A yet further object of this invention is to provide an earphone comprising a housing formed so as to be received in a recess of the concha, a magnetic circuit received in said housing, a diaphragm magnetically coupled to said magnetic circuit and a flange formed around said housing for engaging projections of the concha when said housing is received in the concha.

DESCRIPTION OF THE PREFERRED EMBODIMENTS

Figure 1:
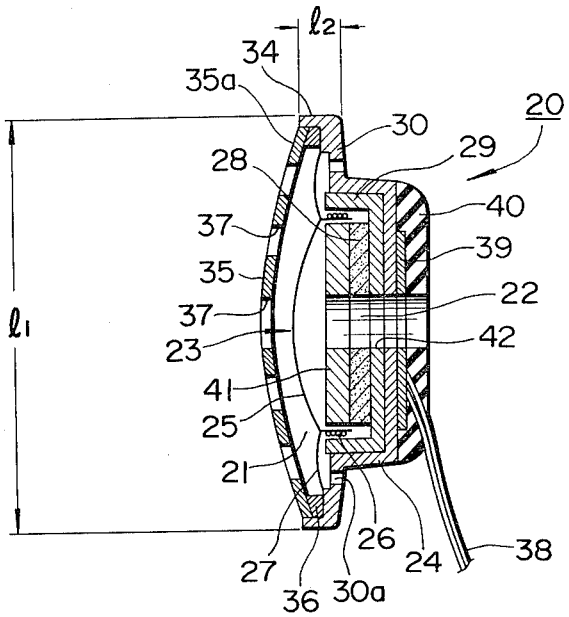
FIG. 1 is a longitudinal section of an earphone according to this invention.
Figure 2:
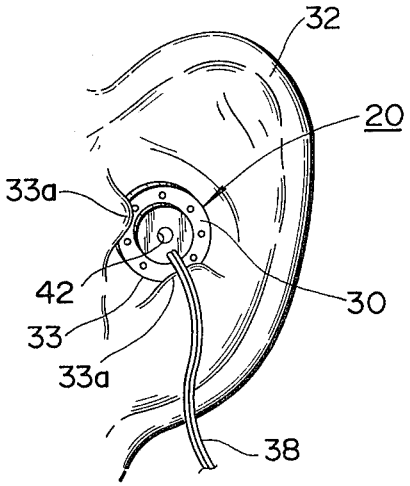
FIG. 2 is a front view of principal portions of the earphone shown in FIG. 1 when it is attached to a recess of the concha.
Figure 3:
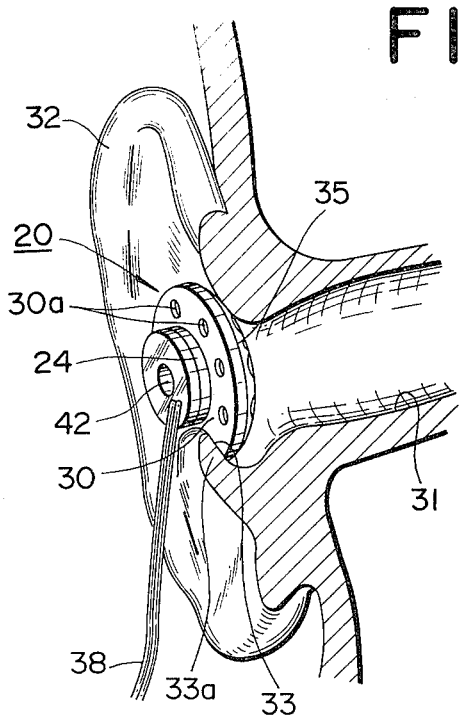
FIG. 3 is a partially cutaway side view of the earphone shown in FIG. 2.

As shown in FIG. 1, an earphone 20 according to this invention is formed of an electroacaustic transducer 23 formed of a vibrating portion 21 and a magnetic circuit 22 and a housing 24 in which the transducer 23 is mounted. Said vibrating portion 21 is formed of a diaphragm 25 having a sufficiently large effective area for reproduction of satisfactory sound. A voice coil 26 is wound around the outer periphery of the annular portion of the diaphragm 25 and an edge 27 is provided for supporting said diaphragm in place. The diameter of said diaphragm 25 is substantially equal to that of the housing 24. Also, the magnetic circuit 22 is formed of an annular magnet 28 formed of rare earth cobalt system magnets such as samarium cobalt magnets which have excellent magnetic performance and a yoke 29 for guiding the magnetic flux generated by the magnet to a magnetic cavity and forming magnetic poles. Further, in the housing 24 are built the respective parts of said vibrating portion 21, the magnetic circuit 22 and other parts. The housing 24 has formed on the outer periphery of its front face an annular flange 30 which projects outwardly. As shown in FIGS. 2 and 3, flange 30 is located at the inlet of the external auditory meatus (canal) 31 where it engages the cartilaginous lugs 33*a* located at predetermined positions of the outer periphery of a recess 33 in the central portion of the shell-like concha 32 which surrounds the external auditory meatus 31 so as to prevent the earphone 20 from undesired disengagement from the concha after the housing 24 is received in said recess 33. Further, the flange 30 is formed to have an outer diameter with a dimension $l_1$ of about 1.8 cm, for example.

This flange 30 has formed on its outer periphery an annular bent-up portion 34 which receives inside a ring 36 which supports said edge 27 and supports the outer periphery 35*a* of a protector 35 which is mounted in front of the diaphragm 25 and which is attached to the bent-up portion 34. Said protector 35 is formed with a plurality of vent hles 37, 37 . . . . Further the front face of this protector 35 may be covered with a material, for example urethane, which is can be to be penetrated by sound. Further, in this embodiment, the thickness $l_2$ of the bent-up portion 34 formed on the flange 30 is about 1.5 mm so that it can be satisfactorily received in the recess 33 in the concha 32.

A terminal board 39 is connected to one end of a cord and is integrally fixed to the back of said housing 24 with a mold portion 40 or the like formed of synthetic resin. This terminal board 39, mold portion 40, pole 41, magnet 28 and yoke 29 are respectively formed in their central portions with a through hole 42 so that the inside and outside of the housing 24 communicate with each other. Thus, the back of the housing 24 is opened to the outside space which provides desirable tonal quality. Also, the mold portion 40 effects a buffer action on the cartilaginous lugs 33*a* of the concha so as not to produce pain when the earphone 20 is attached to the concha.

Further, the flange 30 is formed along the outer periphery of the housing 24 with a plurality of vent holes 30*a*.

Next, there will be described a method of using this invention. As shown in FIG. 3, the earphone 20 according to this invention is received in the recess 33 of the concha 32 such that the protector 35 side is directed towards the external auditory meatus 31 of the concha 32. Since the earphone 20 according to this invention uses a samarium cobalt magnet or the like for the magnet 28 provides a compact and light earphone and, it can be easily received in the recess 33 of the concha 32.

Also, since the earphone 20 according to this invention is received in the inlet of the external auditory meatus 31 of the concha 32, the diaphragm 25 can be located close to the eardrum. Since a samarium cobalt magnet or the like is used for the magnet 28 it forms a sufficiently large effective area for the diaphragm 25 so that the range can be expanded and high fidelity sounds will be obtained.

Further in the earphone 20 according to this invention, since only a portion of the earphone 20, such as the outer periphery of the protector 35, engages the concha 32, the earphone will not become covered with sweat or produce pain and it can be used for a long time without discomfort.

Figure 4:
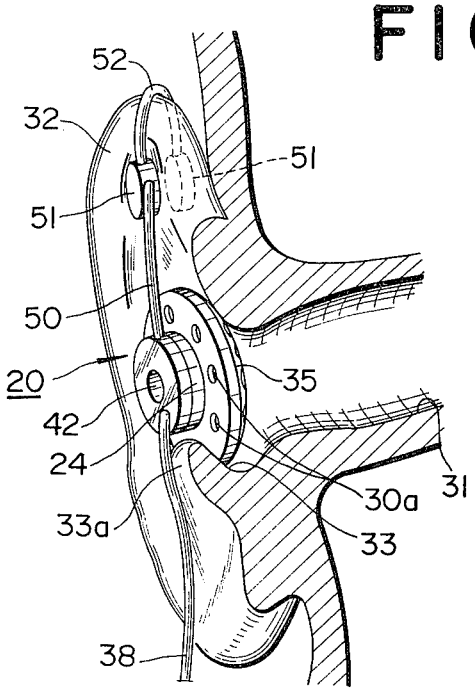
FIG. 4 is a partially cutaway side view of another embodiment of this invention with the earphone shown is attached to the recess of the concha.

FIG. 4 shows an example of an attachment to more securely attach said earphone to the concha.

In this example, the housing 24 of the earphone 20 shown in FIG. 1 is provided with a string or cord member 50 having a pair of sandwiching pieces 51, 51 which form a clip. A pair of sandwiching pieces 51, 51 are interconnected with a connecting flexible string 52 and are respectively formed of magnetic material. At least one of these pieces is formed of a permanent magnet material, as for example rare, earth cobalt permanent magnet material such as samarium cobalt magnet material which has very high magnetic attraction.

The other piece of the sandwiching pieces 51, 51 may be formed of magnetic material such as iron. However, both pieces 51, 51 are preferably formed of permanent magnetic material to adequately support the earphone 20.

As shown in FIG. 4, said pair of sandwiching pieces 51, 51 sandwich both sides of the concha 32 after the earphone 20 is received in the recess 33 of the concha 31 such that the protector 35 side is directed towards the external auditory meatus 31 side of the concha 32. Since magnets having very high magnetic attraction, for example, samarium cobalt magnet, are used for the sandwiching pieces 51, 51, the pieces 51, 51 will be firmly secured to the concha 32. Accordingly the earphone 20 is firmly secured to the concha 32 with these sandwiching pieces so that said earphone 20 can not be disengaged from the concha 32 even when a wearer listens to music while performing strenuous exercises.

Further, while in the above-mentioned embodiment a pair of sandwiching pieces 51, 51 sandwich the upper portion of the concha, a pair of sandwiching pieces provided on the cord 38 may sandwich the lower portion of the concha.

As is apparent from the above description, the earphone according to this invention is sufficiently compact and light for being received in the recess of the concha so that it can be securely attached to the concha and used for a long time and it will provide high fidelity sound since the diaphragm can be located sufficiently close to the eardrum.

Also, since the earphone according to this invention is provided on the outer periphery of the front face of the cabinet with the flange, the earphone cannot be accidentally disengagement from the concha.

Further, the earphone according to this invention is provided with a pair of sandwiching pieces so that the earphone will be prevented from disengagement from the concha even when a wearer performs strenuous exercise with earphone in the concha.

Further, while in the above embodiment of this invention so-called dynamic type earphone is described, this invention can be applied also to an electromagnetic earphone or the like for example.

What is claimed is:

1. An earphone comprising a housing formed so as to be received in a recess of the concha, a magnetic circuit received in said housing, a diaphragm magnetically coupled to said magnetic circuit and with a diameter substantially equal to said housing and a flange formed around said housing for engaging lugs of the concha when said housing is received in the concha and wherein a protector having a plurality of openings is mounted on said flange to protect said diaphragm.

2. An earphone as defined in claim 1, wherein said flange is provided with a plurality of openings.

3. An earphone as defined in claim 1, wherein said housing has a flexible string member secured thereto and carrying a pair of magnetically attracting sandwiching pieces for sandwiching said concha and maintaining the housing secured to the concha.

4. An earphone as defined in claim 3, wherein at least one of said pair of sandwiching pieces is a permanent magnet and the other piece is formed of magnetic material.

5. An earphone as defined in claim 1, wherein said housing is provided on its back side with a buffer member.

* * * * *